US011028692B2

(12) United States Patent
Rataj et al.

(10) Patent No.: US 11,028,692 B2
(45) Date of Patent: Jun. 8, 2021

(54) ROCK BOLT WITH MESHING ADAPTER

(71) Applicant: SANDVIK INTELLECTUAL PROPERTY AB, Sandviken (SE)

(72) Inventors: Mieczyslaw Rataj, Charlestown (AU); Bradley Darlington, Bolwarra Heights (AU); Peter Young, Queensland (AU); Warren Roach, Durren Durren (AU)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 16/766,959

(22) PCT Filed: Nov. 12, 2018

(86) PCT No.: PCT/EP2018/080884
§ 371 (c)(1),
(2) Date: May 26, 2020

(87) PCT Pub. No.: WO2019/101554
PCT Pub. Date: May 31, 2019

(65) Prior Publication Data

US 2020/0318479 A1 Oct. 8, 2020

(30) Foreign Application Priority Data

Nov. 27, 2017 (AU) ..... 2017904776

(51) Int. Cl.
*E21D 21/00* (2006.01)
*E21D 11/00* (2006.01)
*E21D 11/40* (2006.01)

(52) U.S. Cl.
CPC ..... *E21D 11/006* (2013.01); *E21D 21/0026* (2013.01); *E21D 21/0093* (2013.01); *E21D 11/40* (2013.01); *E21D 21/008* (2013.01)

(58) Field of Classification Search
CPC ..... E21D 21/008; E21D 21/0086; E21D 21/0093; E21D 21/0026; E21D 11/006; E21D 11/152; E21D 11/40
See application file for complete search history.

(56) References Cited

U.S. PATENT DOCUMENTS 4,740,111 A * 4/1988 Gagnon ..... E21D 21/0093 405/259.1
5,207,535 A * 5/1993 Saab ..... E21D 21/0086 405/259.1
5,873,689 A * 2/1999 Mensour ..... E21D 21/008 405/259.2

(Continued)

FOREIGN PATENT DOCUMENTS

AU 2006203240 A1 2/2007
AU 2011236039 A1 5/2012

(Continued)

*Primary Examiner* — Carib A Oquendo
(74) *Attorney, Agent, or Firm* — Corinne R. Gorski

(57) ABSTRACT

A rock bolt and meshing assembly is arranged for installation of a meshing sheet against a surface of rock strata. The rock bolt includes an adapter having a first portion connectable to a trailing end of an elongate shaft of the rock bolt and means configured to receive and mount a meshing clamp to overlay a second section of meshing sheet against an already laid first section of meshing sheet.

19 Claims, 3 Drawing Sheets

(56) References Cited

U.S. PATENT DOCUMENTS

| | | | | |
|---|---|---|---|---|
| 6,004,077 | A * | 12/1999 | Saab | E21D 21/0086 405/288 |
| 10,422,223 | B2 * | 9/2019 | Crompton | E21D 21/0093 |
| 2009/0074517 | A1 | 3/2009 | Craig | |
| 2016/0186564 | A1 * | 6/2016 | Evans | E21D 21/004 405/259.1 |
| 2017/0067340 | A1 | 3/2017 | Sieling et al. | |

FOREIGN PATENT DOCUMENTS

| | | | |
|---|---|---|---|
| AU | 2004100042 | A4 | 9/2013 |
| AU | 2013203198 | A1 | 1/2014 |
| WO | 2012053965 | A1 | 4/2012 |

* cited by examiner

ROCK BOLT WITH MESHING ADAPTER

RELATED APPLICATION DATA

This application is a § 371 National Stage Application of PCT International Application No. PCT/EP2018/080884 filed Nov. 12, 2018 claiming priority to AU 2017904776 filed Nov. 27, 2017.

FIELD OF INVENTION

The present invention relates to a rock bolt and a wire meshing assembly for installation of meshing sheet against a surface and rock strata and in particular although not exclusively to a rock bolt and assembly for mounting meshing sheets in overlapping configuration at the rock surface.

BACKGROUND ART

Roof and wall support is vital in underground mining and tunnelling operations. Mine and tunnel walls and roofs often consist of rock strata which require reinforcement to prevent failure, such as fragmentation or collapse. Rock bolts and wire meshing are used widely for reinforcement purposes and containment purposes respectively. Rock bolts are driven into the rock strata and provide reinforcement against major rock fracture, while wire mesh sheets are fixed across the rock surface and are used principally to contain smaller fragments of rock from dislodging and/or falling away from the rock surface.

Rock bolts are installed in a bore which is drilled into the rock strata and the rock bolt is usually secured in the bore by a resin or a cement grout, or they can be frictionally fixed within the bore by mechanical expanders. The trailing end of a rock bolt normally projects a short distance outside of the bore for supporting ancillary fixtures such as rock plates and mining services; pipes and cables for example. The projecting end of the rock bolt can be threaded for connection of ancillary fixtures.

Safety wire meshing or meshing (hereinafter 'meshing') is employed to protect mining workers and equipment from rock fracture or fall whereby the wire meshing is fixed over a section of the rock wall or surface of the underground mine. It is typically convenient for the meshing to be secured against the rock surface by attachment to the projecting ends of several rock bolts. In some arrangements, the rock bolts are installed through the meshing and the rock plate of the rock bolt bears against the meshing to fix or press the meshing against the rock surface. The intention is for the meshing to be installed as close as possible to the rock surface. As mining continues and new sections of rock surface are exposed requiring reinforcement and containment, new meshing must be installed in overlapping arrangement with the edges of the existing or already installed meshing. Depending on the types of rock bolts used, the new meshing may be fixed to the last rock bolts that secure the existing meshing, or additional rock bolts need to be installed.

Australian Patent No 2004100042 relates to the installation of wire meshing, utilising rock bolts for anchoring the meshing and discloses an overlapping arrangement of wire meshing using a single rock bolt. The first or initial meshing is secured against the rock surface via the projecting end of the rock bolt and a rock plate, while the second meshing is secured overlapping the first meshing via a meshing plate and a second nut that threads onto the projecting end of the rock bolt.

The arrangement of Australian Patent No 2004100042 can operate effectively. However, there can be difficulty where the projecting end of the rock bolt does not project sufficiently for attachment of the meshing plate and nut. This can occur where the rock bolt is installed in a 'valley' in the rock surface for example, or where the rock bolt is driven into the rock strata too far or too deeply for the projecting end to sufficiently extend proud of the rock surface for the connection of the second nut and second meshing.

Also, some forms of rock bolts have blind nuts applied to the projecting end of the rock bolt and so a threaded section of the rock bolt does not project for attachment of a meshing plate and nut. In these kinds of rock bolts the first section of wire meshing can be installed as described above to the projecting end of the rock bolt, with the rock plate in bearing engagement with the first section of wire meshing, however the second section of wire meshing cannot be installed. While in some forms of these kinds of rock bolts the blind nuts have an external thread for attachment of an adapter, the thread is usually relatively short and so does not provide sufficient thread for attachment of wire meshing and a meshing plate, particularly if the rock bolt is installed in a 'valley' in the rock surface.

Australian Patent No 2011236039 discloses a rock bolt that includes an adapter for hanging mining services such as pipes and cables. The rock bolt of Australian Patent No 2011236039 has a blind nut of the kind described above that is externally threaded for attachment of a hanger. The hanger provides a point for hanging pipes and cables and the short threaded connection that the hanger makes with the blind nut is sufficient for the hanger to support these types of mining services, but would not be sufficient for supporting wire meshing.

US Patent Application 20170067340 discloses a similar arrangement to that disclosed in Australian Patent No 2011236039, in that an adapter for attaching a safety line for an assembly worker is provided.

Where there is an absence of a sufficient extent of a projecting end of the rock bolt to attach wire meshing, usually additional rock bolts need to be installed just for the meshing to be installed. This is much more costly than using the existing rock bolts, because of the additional cost of the rock bolt and the additional time taken for installation.

SUMMARY OF THE INVENTION

It is an objective of the present invention to provide a rock bolt and a wire meshing assembly for insulation of meshing sheet against a surface of rock strata in which common rock bolts are utilised to secure first and second sections of meshing sheet in overlapping arrangement. It is a specific objective to provide a rock bolt and assembly that avoids the need for additional rock bolts at the interface or junction between sections of meshing.

It is a further specific objective to provide a rock bolt and insulation assembly configured for the secure mounting of containment meshing at highly contoured or uneven surfaces of rock strata that include troughs, cavities, valleys and the like.

The objectives are achieved via a rock bolt and meshing installation assembly having an adapter connectable to an exposed trailing end of a rock bolt with the adapter configured to mount a meshing plate to bear against and urge a further second section of meshing sheet in overlapping contact against a first meshing sheet section already mounted at the rock surface via the rock bolt. The adapter is advantageous to provide an axial extension of the trailing end of the rock bolt where the rock bolt does not protrude a sufficient axial length to receive and mount a meshing plate (to bear against the second or further section of meshing sheet). Accordingly, via the present adapter, the need for additional rock bolts to secure the further second meshing sheet at the same overlapping location of the first sheet is avoided so as to enable the same and common rock bolts to be utilised to secure both overlapping meshing sheet sections. A rock bolt according to the present invention advantageously facilitates attachment of the second section of wire meshing overlapping the first section via a single (common) rock bolt which saves time, cost and effort.

The present invention can be employed with any type rock bolt that has an end that protrudes from a bore. Thus, the present invention can be used with resin or cement grouted bolts and mechanical friction bolts. Resin or cement grouted rock bolts normally comprise a bar that is installed in a bore and a resin or grout is injected or otherwise introduced into the bore about the bar for the purpose of anchoring the bar in the bore. Mechanical friction bolts usually comprise an outer tube that is split longitudinally to allow radial expansion and contraction of the diameter of the tube and an expander mechanism within the tube that can be activated once the rock bolt is inserted into a bore to apply a load tending to cause the tube to radially expand in order to increase the frictional engagement between the tube and the bore wall or surface.

In all forms of rock bolt, an end of the bolt will protrude from the bore for the purpose of for example, supporting a rock plate and other mining services as might be required, such as pipes and cables. The protruding end will sometimes be threaded for connection of a nut or the like as required to secure a rock plate or other mining services. Each of Australian Patent No 2004100042 and International PCT Patent Application No 2012053965 and US Patent Application 20170067340 disclose such arrangements. Australian Patent No 2004100042 shows a resin or grouted bolt in which the protruding end supports a nut for securing a rock plate and a further nut for securing a meshing plate. The present invention could be applied to Australian Patent No 2004100042 by applying an adapter of the invention to the protruding end of the rock bolt in circumstances where the protruding end does not protrude sufficiently for the nut that secures the meshing plate to be attached.

International PCT Patent Application No 2012053965 discloses a rock bolt that has a blind nut secured to one end. Because the nut is blind, there is not sufficient room for a meshing plate and nut to be applied to the rock bolt. Accordingly, the present invention could be applied to a rock bolt of the type described in International PCT Patent Application No 2012053965 in which the nut is configured with an external thread and applying an adapter of the invention to the nut. The adapter then provides the necessary extension for attachment of a meshing plate and nut.

The present invention thus can be applied to various forms of rock bolt and includes cable bolts as well. This form of rock bolt can be seen in International PCT Patent Application No 2013203198 and as with the other rock bolts discussed above, also includes a protruding end for the attachment of a meshing plate and nut, or where the protruding end is not sufficient, for the attachment of an adapter of the invention. It follows that the present invention is applicable to many forms of rock bolt subject to the bolt having a protruding end to which the adapter of the invention can be applied.

Advantageously, the manner in which the nut is fixed to the extension of the adapter means that a single installation device or equipment can be used to attach the adapter to the shaft of the rock bolt and to thereafter drive the mesh clamp to the mesh clamping position. This differs from prior art arrangements, in which a connector or adapter suitable to attach a meshing plate is first attached to the rock bolt and thereafter the meshing plate is attached to the connector or adapter. This two-stage installation process of the prior art is required as a result of the particular form of the prior art adapters and meshing plates and means that installation of the meshing plates is more time consuming and thus less convenient than in the present invention.

It is to be appreciated that the time taken to install meshing over a section of exposed rock face is important to maximise the safety of personnel working within a mining area. Therefore, the quicker the exposed rock face can be covered by wire meshing, the quicker the mining area can be rendered safe for mining personnel.

Moreover, the present invention can provide a significant advantage in that the adapter can be attached to the installation equipment and can remain attached to that equipment while that equipment lifts the meshing in to the position at which it is to be installed. Thus, the installation equipment can lift the meshing and position it at the installation position and when properly positioned, the equipment can then align the adapter with the trailing end of the rock bolt shaft, and engage the adapter to connect the adapter to the shaft. This connection of the adapter can be made while the installation equipment holds the meshing in the position for installation. Once the adapter has been connected to the rock bolt shaft, the installation equipment can cause a part of the adapter in order to drive the mesh clamp to clamp the section of meshing in place. This again differs from the prior art, in which an adapter is first connected to the trailing end of the rock bolt shaft, the meshing is placed over the adapter and then the meshing plate is rotated or placed into a clamping position. In the present invention, the installation equipment can connect the adapter to the rock bolt and clamp the meshing in place as a single installation operation.

The present invention has been developed with the connection portion of the adapter being threaded so that the nut connects to the connection portion. In this form of the invention, in internal region of the connection portion of the adapter and an external region of the trailing end of the elongate shaft are also both threaded for mutual threaded connection. In practice, the threaded connection between the adapter and the rock bolt shaft is achieved by rotating the adapter into connection with the bolt shaft. For this, installation equipment engages the nut with the nut in a first position at the connection portion of the adapter and rotates the nut. Because the nut is fixed to the connection portion against rotation relative to the connection portion, the nut will not rotate relative to the connection portion but rather, the nut and connection portion will rotate together and that will rotate the complete adapter for connection to the trailing end of the rock bolt shaft.

Once the adapter is connected to the trailing end of the elongate shaft, further rotation of the nut will cause the nut to adopt the second movable connection to the connection portion, so that the nut will rotate relative to the connection portion and will drive or push the mesh clamp to a mesh clamping position.

While aspects of the present invention has been developed with the threaded arrangement discussed above, other aspects of invention covers arrangements in which the adapter is not threaded onto the trailing end of the rock bolt shaft and/or in which the nut is not threaded onto the extension. For example, the adapter can be connected to the trailing end of the rock bolt shaft by an interference fit or by other connection in which rotation of the adapter is not required. In that form of the invention, the installation equipment can engage the adapter to force the adapter into connection with the trailing end of the rock bolt shaft. That engagement can be engagement of the nut of the adapter whereby nut is thus fitted to the extension in a first fixed connection for engagement by the installation equipment, but the engagement is not rotational engagement. However, the installation equipment could equally engage a different component or part of the adapter to force the adapter into connection with the trailing end of the rock bolt shaft. The installation equipment could for example apply a percussive load to the end of the extension, or the extension could have a step or shoulder that is provided for engagement with a percussive load.

Likewise, the nut can be a friction fit on the connection portion (such as by crimping) and in that fixed state on the connection portion, the nut can be rotated if the adapter rotatably connects to the trailing end of the rock bolt shaft or it can be percussively driven if the adapter frictionally connects to the trailing end of the rock bolt shaft.

In some forms the above form of the invention, the second movable connection of the nut on the connection portion can be a frictional movement in which the load applied to the nut overcomes the frictional load between the nut and the connection portion and shifts the nut relative to the connection portion to drive the mesh clamp to a mesh clamping position. Despite this movement of the nut along the connection portion, the nut will maintain a high frictional connection with the connection portion to support the mesh clamp in the mesh clamping position. The cooperating surfaces of the nut and the connection portion can be roughened or ribbed or otherwise treated or formed in order achieve this high frictional connection.

It will be appreciated that the use of the term 'nut' or 'body' is intended to cover a component that threadably connects to a threaded connection portion and/or elongate extension as well as a component that connects to the connection portion other than by thread and in particular by friction or interference fit.

Within this specification, reference to the rock bolt comprising an 'elongate shaft' encompass the rock bolt having an elongate bar, rod or cable to which tension is capable of being applied during anchorage of the rock bolt into the as-formed bore. Accordingly, reference within this specification to the elongate shaft having 'a trailing end' encompasses an end of a bar, rod or cable, a nut, socket or other connection component attached to the elongate shaft. Accordingly, the present invention encompasses the present adapter being connectable directly or indirectly to the trailing end of the elongate shaft.

According to a first aspect of the present invention there is provided a rock bolt for installation within a bore formed in rock strata comprising: an elongate shaft having a leading end for installation into the bore and a trailing end to project from an open end of the bore; an adaptor having: a connection portion connectable to the trailing end of the elongate shaft; and a body having an internal facing surface mateable with an external facing surface of the connection portion; and a mesh clamp mountable at the body or axially between an axially forwardmost part of the connection portion and the body such that the body is drivable axially on the connection portion via the engagement between the internal facing surface the external facing surface to force the meshing clamp towards the trailing end of the elongate shaft and to bare against and urge a meshing sheet into contact with a surface of the rock strata.

Optionally, the connection portion comprises an internal thread mateable with an external thread of a nut secured to the trailing end of the elongate shaft.

Optionally, at least a region of the connection portion comprises an external thread at the external facing surface and at least a region of the body comprises an internal thread mateable with the external thread of the connection portion such that the body is axially driveable along the connection portion via the threads. The threading is advantageous for convenient and reliable axial advancement of the body on the extension using common external tooling.

Optionally, the connection portion comprises an extension extending axially from said forwardmost part, wherein the meshing clamp is mountable on the extension between said forwardmost part and the body. Optionally, the external thread is provided at the extension. Optionally, the body is a nut rotatable on the extension towards said forwardmost part to drive axially the mesh clamp towards the socket. Optionally, the internal thread of the connection portion is formed within a socket at said forwardmost part from which the extension projects.

Optionally, the body comprises a nut head and a nut collar, the internal thread of the body provided at the collar such that the collar is axially drivable over and along the connection portion to force the meshing clamp towards the trailing end of the elongate shaft.

Optionally, the body comprises a first fixed connection to the connection portion, whereby installation equipment can rotate the body to rotate both the body and the adapter together for threadably connecting the adapter to the trailing end of the elongate shaft of the rock bolt.

Optionally, the first fixed connection of the body to the connection portion comprises a shear pin extending between the body and the connection portion. Optionally, the first fixed connection of the body to the connection portion comprises a spot weld or braze, gluing or crimping between the body and the connection portion. Preferably, the body has both a first fixed connection to the connection portion and a second movable connection to the connection portion. In the preferred arrangement, the first fixed connection enables the adapter to be rotated with the body in order for the adapter to be threadably connected to the trailing end of the rock bolt shaft. In the preferred arrangement, the second rotatable connection enables the body to be rotated relative to the threaded connection portion of the adapter in order to drive the mesh clamp forward and into a clamping position relative to the meshing. The first fixed connection can be made in any suitable form in the preferred arrangement such as by the use of a shear pin that extends between the nut and the extension. Thus, the body can be formed with an opening that can align with a complementary opening in the connection portion and a shear pin can be extended through the respective openings to fix the body to the connection portion. The shear torque strength of the shear pin must be high enough to overcome any resistance to the action of threadably coupling the adapter to the rock bolt shaft, but must be lower than the maximum torque output of the installation equipment, i.e. a mining Jumbo for example. Typically, in a mining Jumbo, the maximum torque output is 400 Nm and thus the shear torque strength of the shear pin can be in the region of 150 Nm to 300 Nm. Alternative arrangements to fix the body to the connection portion include spot welding or brazing, crimping or gluing.

Optionally, the mesh clamp comprises an opening through which the extension extends. Optionally, the opening has an internal diameter that is greater than the external diameter of the extension so that the mesh clamp is a loose fit about the extension.

Optionally, the mesh clamp comprises an opening through which a portion of the body extends axially between the nut head and the nut collar.

Optionally, the mesh clamp has a base in which the opening is formed and arms that extend from the base to a ring configured for engagement of the meshing sheet.

Optionally, the mesh clamp has a base in which the opening is formed and a skirt extends from the base, wherein the skirt has a distal end remote from the base for engagement of the meshing sheet. Optionally, the distal portion or end remote from the base may be annular, part annular or otherwise be configured for abutment against the meshing sheet.

Optionally, the base is planar and extends generally perpendicular to an axis of the rock bolt. Where the mesh clamp includes a base, it can also include fingers or a skirt or dish that extends from the base for engagement with the meshing to be clamped. The skirt can be a continuous skirt and can include an edge or portion which is remote from the base for engagement with the mesh. The skirt and/or the edge or portion may be circular/annular or any other suitable shape. Alternatively, where fingers are provided, these can extend to a ring for engagement with the meshing. A pair of fingers can extend to a ring from the base in a symmetrical manner or three or four fingers can extend to the ring symmetrically. This arrangement has advantages in that the adapter is open between the fingers which allows the installation personnel better ability to see the end of the rock bolt to which the adapter is to be connected.

Optionally, the body is mounted to the connection portion via a friction fit and the body is movable axially along the connection portion by application of a load applied to the body which is sufficient to overcome a friction connection between the body and the connection portion. Accordingly, the body may be capable of sliding axially along the connection portion by a compressive external force applied to the body in the direction of the longitudinal axis of the rock bolt.

According to a second aspect of the present invention there is provided a meshing assembly for installation of meshing sheet against a surface of rock strata comprising: a rock bolt as claimed herein; a first section of meshing positionable against the surface of the rock strata; a rock plate connectable to the trailing end of the rock bolt to bear against and urge the first section into contact with the surface of the rock strata; a second section of meshing positionable against the surface of the rock strata and overlapping the first section; and a meshing clamp connectable to the connection portion and configured to bear against and urge the second section into contact with the surface of the rock strata.

According to a further aspect of the present invention there is provided an adapter for connection to a rock bolt of the kind that has an elongate shaft which has leading and trailing ends for installation in a bore which is drilled into a rock strata, the adapter having a connection portion which is connectable to the trailing end of the elongate rock bolt shaft and including an elongate extension on which is mounted a mesh clamp and a nut, the mesh clamp being mounted between the connection portion of the adapter and the nut, the adapter being connectable to the trailing end of the elongate rock bolt shaft with the nut movable along the elongate extension to drive the mesh clamp to a mesh clamping position.

The present invention also provides a rock bolt with an adapter according to the invention attachable to one end of the rock bolt. The invention may be provided in kit form or fully assembled According to a further aspect of the present invention there is provided a method of installing wire meshing against a wall surface, the method including:

i. installing a rock bolt in a bore drilled into a rock strata, the rock bolt having an elongate shaft which has leading and trailing ends, ii. installing a first section of wire meshing between a wall surface of the rock strata adjacent the bore and connecting a rock plate to the trailing end of the shaft and fixing the rock plate in place to sandwich the wire meshing between the wall surface and the rockplate, iii. installing a second section of wire meshing into an overlapping position with the first section of wire meshing by inserting an adapter into an opening of the wire meshing and lifting the adapter with installation equipment to lift the wire meshing into the overlapping position, the adapter having a section for connecting to the trailing end of the rock bolt shaft and having a connection portion on which is mounted a mesh clamp and a body, iv. causing the installation equipment to engage the adapter to connect the adapter to the trailing end of the elongate shaft, v. subsequently causing the installation equipment to engage and move the body relative to the connection portion to drive the mesh clamp to a mesh clamping position to clamp the second section of wire meshing in the overlapping position with the first section of wire meshing.

In the first fixed connection of the body the installation equipment can rotate the body to rotate the body and the adapter together for threadably connect the adapter to the trailing end of the elongate shaft, and in the second rotatable connection to the threaded extension the installation equipment can rotate the body relative to the threaded extension to drive the mesh clamp to a mesh clamping position.

According to a further aspect of the present invention there is provided a method of installing a second section of wire meshing overlapping a first section of wire meshing where the first section of wire meshing is already installed against a wall surface by connection to an installed rock bolt, the method including:

i. installing a second section of wire meshing into an overlapping position with the first section of wire meshing by inserting an adapter into an opening of the wire meshing and lifting the adapter with installation equipment to lift the wire meshing into the overlapping position, the adapter having a section for connecting to the trailing end of the rock bolt shaft and having a connection portion on which is mounted a mesh clamp and a body, ii. causing the installation equipment to engage adapter with the body in the first fixed connection to connect the adapter to the trailing end of the elongate shaft, iii. subsequently causing the installation equipment to engage and move the body relative to the connection portion to drive the mesh clamp to a mesh clamping position to clamp the second section of wire meshing in the overlapping position with the first section of wire meshing.

The installation equipment can be of any suitable form but a common form used in underground mining for the installation of rock bolts, is known generically as a mobile bolter or as a 'Jumbo' which is a mining vehicle that includes an arm or boom which has the capability of percussion driving and rotation for installing rock bolts and components within underground mines. With the adapter of the invention, a mining Jumbo can have the adapter attached to the arm or boom and the adapter can remain attached to the arm or boom while the meshing is lifted by the arm or boom and the arm or boom can then bring the adapter into position for connection to the rock bolt as explained above. The adapter can even be used to lift the meshing, given that in some forms of an adapter according to the invention, the end of the adapter which connects to the shaft of the rock bolt includes an enlarged diameter socket, which can be inserted through an opening in the meshing in order to hook the meshing when the arm or boom is lifted. Thus, the adapter advantageously can facilitate lifting of the meshing so that the arm or boom is not required to include an alternative component to do this. Of course, the Jumbo can raise the meshing quite separately without the adapter being used to hook the meshing. Suitable installation equipment can engage either the body or other parts of the adapter to connect the adapter to the trailing end of the elongate shaft of the rock bolt. The installation equipment could for example, engage the end of the connection portion, or the connection portion could have a step or shoulder that is provided for engagement.

An adapter according to the present invention can be sized so that the leading end of the adapter can fit through an opening in the meshing to be installed, while the manner of connecting the body to the connection portion by appropriate 'connections' mean that the adapter does not need to be connected to the rock bolt prior to the meshing being fitted over the adapter. Advantageously, the adapter and the meshing can be lifted as one for subsequent connection to the installed rock bolt.

According to a further aspect of the present invention there is provided a wire meshing installation, the installation including:

i. a rock bolt having an elongate shaft which has leading and trailing ends installed in a bore drilled into a rock strata, the trailing end being threaded, ii. a first section of wire meshing installed between a wall surface of the rock strata adjacent the bore and a rock plate connected to the trailing end of the shaft, iii. an adapter according to any of the forms described herein, connected to the trailing end of the shaft, iv. a second section of wire meshing installed overlapping the first section of wire meshing and being clamped in the overlapping position by the mesh clamp.

According to a further aspect of the present invention there is provided an adapter for connection to a rock bolt of the kind that has an elongate shaft which has leading and trailing ends for installation in a bore which is drilled into a rock strata, the adapter having a connection portion which is connectable to the trailing end of the elongate rock bolt shaft and including a connection portion on which is mounted a mesh clamp and a body, the mesh clamp being axially moveably mounted at the adapter, the adapter being connectable to the trailing end of the elongate rock bolt shaft with the body mounted in a first position thereon and the body being axially movable relative to the connection portion (ie. from a first position distal to the rock bolt to a second position proximal to the rock bolt) to drive the mesh clamp to a mesh clamping position.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
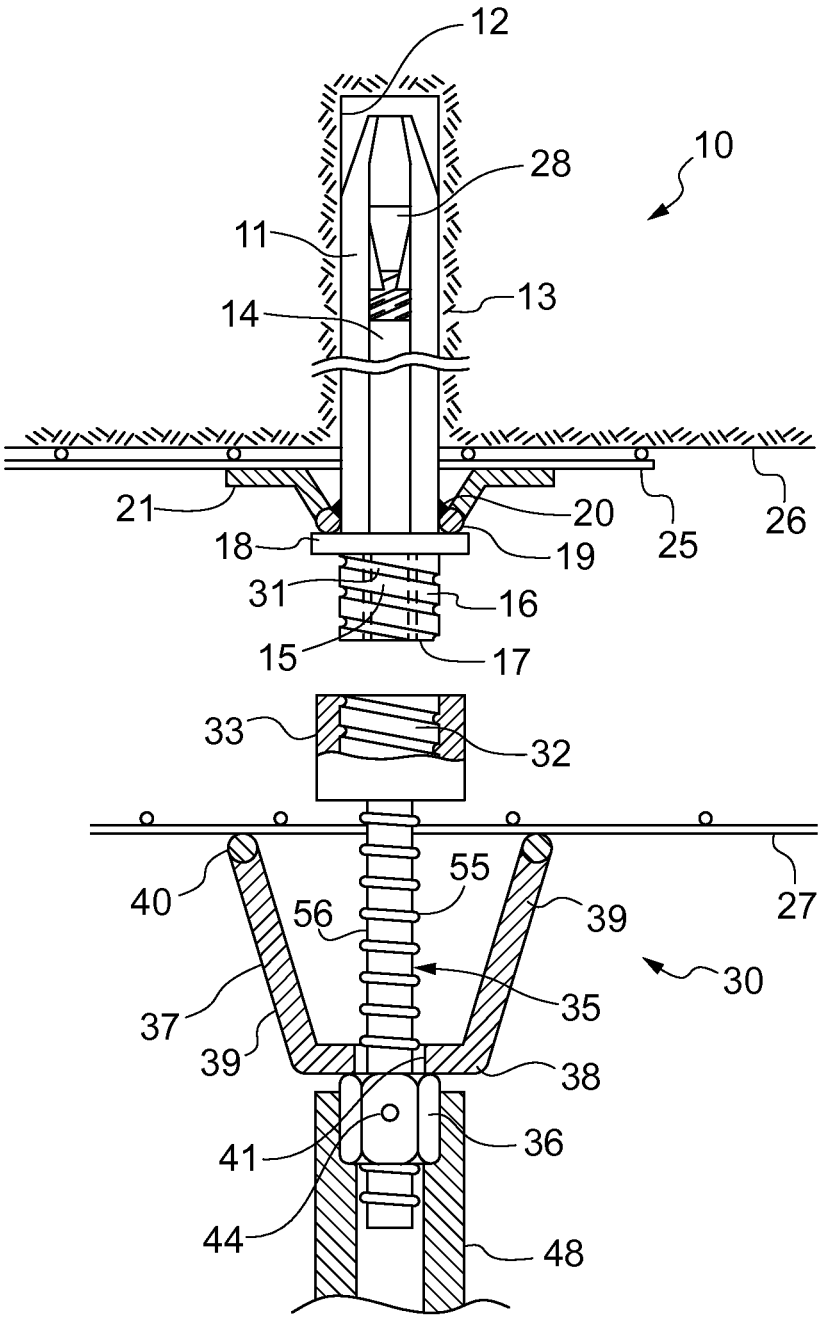
FIG. 1 is an exploded sectional view of a wire meshing installation according to the invention.
Figure 2:
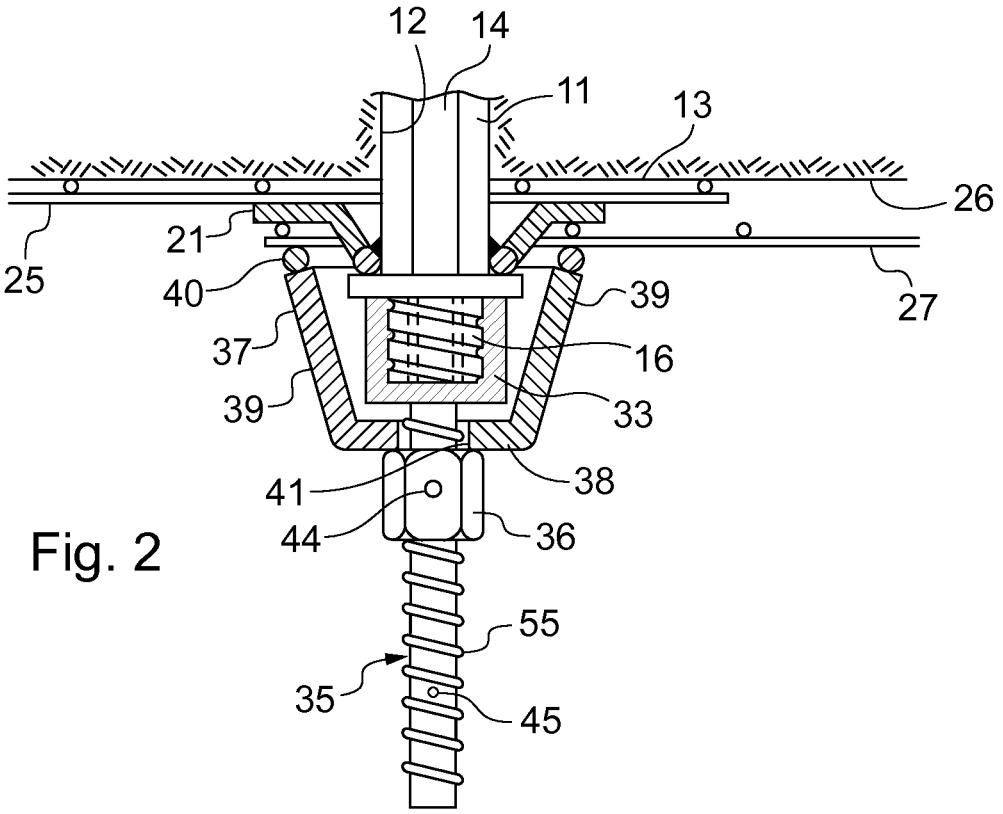
FIG. 2 is an assembled sectional view of the wire meshing installation of FIG. 1.

With reference to FIGS. 1 and 2, a rock bolt 10 according to the invention is illustrated and comprises a split tube 11 that extends into a bore 12 that is drilled into rock strata 13. The length of the split tube 11 can be in the order of 1 m to 3 m.

The rock bolt 10 is of the kind that includes an expander mechanism within the split tube 11 towards the leading end of the tube 11. The expander mechanism is shown in simplified form at reference numeral 28 in FIG. 1. The expander mechanism comprises a wedge arrangement and one component of the wedge arrangement connects to a bar 14 that is positioned within the tube 11. In the embodiment illustrated in FIG. 1, rotation of the bar 14 within the tube 11 is operable to activate the expander mechanism to shift the wedge arrangement to expand inside the tube 11, thus tending to expand the tube 11 radially against the facing surfaces of the bore 12. This serves to cause the tube 11 to more firmly engage the surface of the bore 12, so as to firmly anchor the tube 11 within the bore 12. By this action, the rock bolt 10 provides rock strata reinforcement. An expander mechanism that operates in this manner is disclosed in Australian Patent Application No 2017901751.

The trailing end of the bar 14 projects out of the bore 12 and thus forms a projecting end 15. As shown in FIG. 1, a blind nut 16 is attached to the projecting end 15 and has a closed end 17. By this arrangement, threading the blind nut 16 onto the projecting end 15 eventually brings the closed end 17 into contact with the end face of the projecting end 15, so that further rotational movement of the blind nut 16 relative to the bar 14 is prevented. That is, any further rotation of the blind nut 16 results in combined rotation of the bar 14 and the nut 16. By this mechanism, rotation of the nut 16 facilitates activation of the expander mechanism 28.

Adjacent the blind nut 16 is a washer 18 and inward of the washer 18 is a ring 19. The ring 19 is welded by weld 20 to the outer surface of the tube 11 and provides a bearing surface for a rock plate 21. The rock plate 21 bears against wire meshing 25 and urges the meshing 25 into surface contact with the rock surface 26 of the rock strata 13. The rock bolt 10 is supplied with the ring 19 welded in place against the tube 11 and is installed by applying the washer 18 and the blind nut 16 to one side of the ring 19 and the rock plate 21 to the other side. The wire meshing 25 can be positioned against the rock surface 26 and the tube 11 can then be passed through the meshing 25 and driven into the bore 12 by suitable driving equipment, such as under percussion hammering by a mining Jumbo. When the tube 11 has been driven to the required depth within the bore 12, the blind nut 16 can be rotated to rotate the bar 14 and to activate the expander mechanism which is located towards the leading end of the tube 11. With these steps completed, the rock bolt 10 is installed and the meshing 25 is firmly positioned against the rock surface 26. The rock strata is thus reinforced against rock fracture and the rock surface 26 above the meshing 25 is contained against dislodgment of smaller fragments.

A second section of wire meshing will be required to be installed as further sections of rock surface are exposed. It is necessary that the new section of wire meshing overlap an existing section, so that no sections of the rock face are left un-contained or un-protected. Accordingly, the same rock bolt 10 that is used to secure the wire meshing 25 in place against the rock surface 26 can be used in accordance with the present invention to secure a second section of wire meshing 27. In accordance with the invention, an adapter 30 is employed and this threads on to the blind nut 16. In that respect, FIG. 1 shows the thread 31 of the blind nut 16 that is applied to the outer hexagonal surface of the nut 16. The thread is thus made through the corners and flats of the nut 16, so that the nut 16 can be threaded onto the projecting end 15 of the bar 14 and used to drive rotation of the bar 14 to activate the expander mechanism within the split tube 11.

Figure 4:
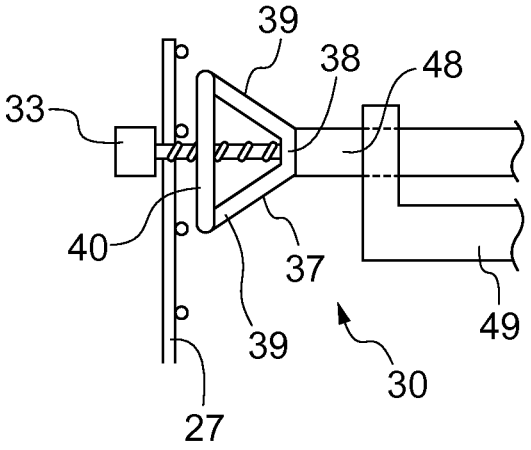
FIG. 4 is a side view of an adapter according to the invention in engagement with installation equipment and wire meshing.
Figure 3:
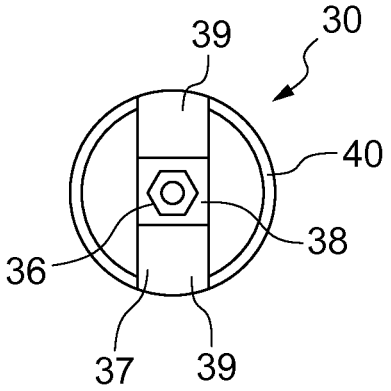
FIG. 3 is an end view of an adapter according to the invention.

The adapter 30 includes a thread 32 within a socket or connection portion 33 so that the adapter 30 can be threadably connected to the blind nut 16. An extension or bar 35 having an external surface 56 is coaxial with the socket portion 33 and extends from the socket portion 33. Preferably bar 35 comprises a thread 55 at external surface 56 for the connection of a nut 36 having a corresponding internal facing surface with complementary thread (not shown) mateable with the thread 55 of the bar 35. Between the socket 33 and the nut 36 is a mesh clamp 37. FIGS. 3 and 4 show the adapter 30 in end and side views respectively and it can be seen that the adapter 30 includes a base 38 and a pair of arms 39 that extend to a ring 40 and the ring 40 in use, bears against a facing surface of the meshing 27 to push the meshing 27 into the position shown in FIG. 2 in an overlapping arrangement with the existing edge of the meshing 25.

The base 38 of the mesh clamp 37 includes a central opening 41 through which the bar 35 extends. It can be seen in FIG. 1, that the internal diameter of the opening 41 is greater than the external diameter of the bar 35 (including the thread that is applied to the bar 35), so that the mesh clamp 37 is a close but loose fit about the bar 35. In particular, the opening 41 is not intended to threadably connect with the bar 35. The nut 36 includes an opening 44 which accommodates a shear pin. The shear pin extends through the opening 44 and into a complementary opening 45 (see FIG. 2) in the bar 35 and with the shear pin accommodated within the respective openings 44 and 45, the nut is in fixed connection with the bar 35. In that connected state, installation equipment can engage the nut 36 and rotate it. By that rotation, each of the bar 35 and the socket 33 will also be rotated. Accordingly, by rotating the nut 36 in fixed connection to the bar 35, the socket 33 can be rotated to threadably connect with the nut 16 of the rock bolt 10. This connected arrangement is illustrated in FIG. 2.

Each of FIGS. 1 and 4 show the nut 36 in engagement with installation equipment, although only the nut engagement end of the equipment is illustrated in FIG. 1. That engagement is via a suitable socket or spanner 48. FIG. 4 shows schematically, the end of a boom or arm 49 of a mining Jumbo or other suitable equipment, which carries the spanner 48 and which drives the spanner to rotate. Once the bar 35 and socket 33 have been driven to the position in which the socket 33 is in full engagement with the nut 16 of the rock bolt 10, further rotation of the nut 36 will shear the shear pin and will then allow the nut 36 to be rotated relative to the bar 35 in the normal manner of a nut, so that the nut 36 traverses along the bar 35. The nut 36 can thus move from the position shown in FIG. 1 to the advanced position shown in FIG. 2 and with that movement, the nut 36 will engage against a facing surface of the base 38 of the mesh clamp 37 and drive it forward to the position shown in FIG. 2 in which it clamps the meshing 27 in overlapping relationship with the meshing 25.

Advantageously, it will be appreciated that the two separate rotation stages of the nut 36 can be performed with the spanner 48 in constant engagement with the nut 36. Thus, the spanner 48 does not need to be disengaged from the nut 36 once engagement has been made, so that both the attachment of the adapter 30 to the rock bolt 10 and the clamping of the meshing 27 by the mesh clamp 37 is all undertaken with the spanner 48 in driving connection with the nut 36. The installation of the meshing 27 via the adapter 30 is thus effectively a single stage operation.

Moreover, a significate advantage provided by the present invention is that the adapter 30 can be utilised in the raising and positioning of the meshing 27 for installation of the meshing 27 in overlapping relationship with the meshing 25. FIG. 4 shows in schematic form, the adapter 30 with the socket 33 extended through an opening in the meshing 27. In that position, the socket 33 can hook the meshing 27 and when the boom 49 is lifted, the meshing 27 will also be lifted in connection with the adapter 30. Thus, with the meshing 27 being lifted by the boom 49 as shown in FIG. 4, the boom 49 can position the socket 33 for connection to the nut 16 of the rock bolt 10 still with the meshing 27 attached to the adapter 30 as shown in FIG. 4. By this arrangement, there is no need for a separate lifting and positioning of the meshing 27 in overlapping position with the meshing 25. In this arrangement, it is necessary for the outside diameter of the socket 33 to be sized sufficiently that it can fit through an opening in the meshing 27 but with those dimensions, the adapter 30 can be used to hook the meshing 27 and lift it for installation into the position shown in FIG. 2. This further enhances the single stage operation for installation of the meshing 27, as compared to the prior art, in which meshing is firstly positioned where required and thereafter, an adapter and then a meshing plate are subsequently installed.

Figure 5:
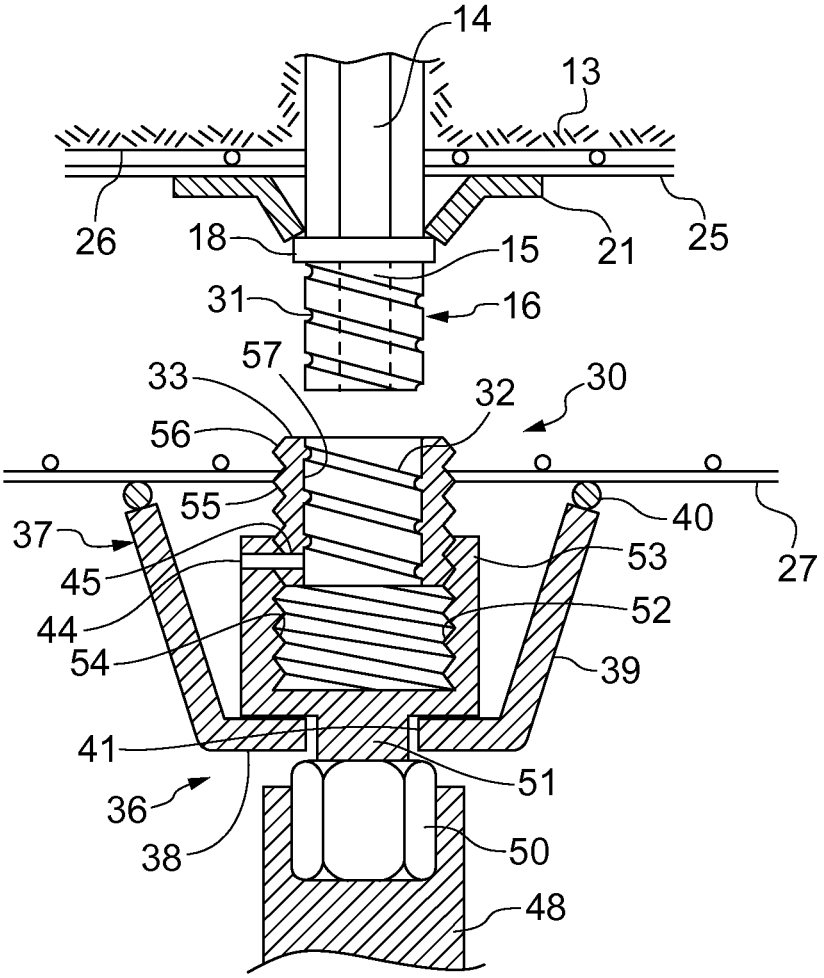
FIG. 5 is a cross section view of a further implementation of the present adaptor and rock bolt.

A further embodiment of the adaptor is described referring to FIG. 5. According to the further embodiment, connection portion 30 is formed as a cylindrical socket 33 having an external surface 56 comprising a thread 55 and an internal surface 57 comprising a thread 32. Thread 32 is configured for mateable engagement with thread 31 of blind nut 16 secured to the trailing end 15 of elongate shaft 14. Socket 33 further comprises an external surface 56 comprising a thread 55. Threads 55 and 32 extend substantially the full axial length of socket 33 between respective forward and rearward axial ends.

According to the further embodiment, adaptor 30 further comprises body 36 comprising a nut head 50 and a nut collar 53 connected axially via a neck section 51. As described referring to the embodiment of FIGS. 1 to 4, nut head 50 is engageable by engagement apparatus 48 to drive rotation of the body 36. Mesh clamp 37 is secured over and about body 36. In particular, opening 41 is positioned around neck 51 with the arms 39 extending over and about nut collar 53 and a portion of socket 33.

Nut collar 53 comprises an internal cavity defined by an internal facing surface 54. A thread 52 is provided at surface 54 for mateable engagement with thread 55 of connection portion 30. Accordingly, connection portion 30 is configured for mating onto blind nut 16 and nut collar 53 is capable of mating onto connection portion 30 via the respective threads 52, 55, 32 and 31. As described referring to FIGS. 1 to 4, a shear pin is securable through respective openings 44, 45 at nut collar 53 and connection portion 30 so as to temporarily and rotationally lock body 36 to connection portion 30 during an initial installation of the adaptor 30 onto the rock bolt 10. As described previously, further rotation of body 36 provides a shearing of the pin inserted through holes 44, 45 to provide continued rotation of body 36 axially along connection portion 30 to force meshing 27 onto the rock surface 26 to be overlapping onto the pre-installed meshing 25.

The present invention is expected to provide significant time savings in the installation of meshing and that advantage has significant benefits in terms of the securing unsecured rock faces quickly and efficiently, thus reducing the likelihood of rock fracture or fall within underground mines. That is, the sooner a rock face is protected by wire meshing, the sooner the section of underground mine is rendered safe to personal and equipment operating within the mine environment.

The invention claimed is:

1. A rock bolt for installation within a bore formed in rock strata, the rock bolt comprising:

an elongate shaft having a leading end for installation into the bore and a trailing end arranged to project from an open end of the bore;

a nut secured to the trailing end of the elongate shaft; and an adaptor having a connection portion, a body and a mesh clamp extending along a longitudinal axis of the bolt, the connection portion including an external facing surface and an internal thread, the internal thread being arranged to mate with an external thread of the nut so as to be connected to the nut at the trailing end of the elongate shaft, the body having an internal facing surface arranged to mate with the external facing surface of the connection portion, wherein the mesh clamp is arranged at the body or axially between an axially forwardmost part at an end of the connection portion and the body, such that the body is drivable axially on the connection portion via the engagement between the internal facing surface and the external facing surface to force the mesh clamp towards the trailing end of the elongate shaft and to bare against and urge a meshing sheet into contact with a surface of the rock strata.

2. The rock bolt as claimed in claim 1, wherein the connection portion includes an extension extending axially from said forwardmost part, wherein the mesh clamp is arranged to be mounted on the extension between said forwardmost part and the body.

3. The rock bolt as claimed in claim 2, wherein at least a region of the connection portion includes an external thread at the external facing surface and at least a region of the body includes an internal thread arranged to mate with the external thread of the connection portion such that the body is axially driveable along the connection portion via the internal and external threads.

4. The rock bolt as claimed in claim 3, wherein the external thread is provided at the extension.

5. The rock bolt as claimed in claim 3, wherein the body includes a nut head and a nut collar, the internal thread of the body being provided at the collar such that the collar is axially drivable over and along the connection portion to force the mesh clamp towards the trailing end of the elongate shaft.

6. The rock bolt according to claim 5, wherein the mesh clamp includes an opening through which a portion of the body extends axially between the nut head and the nut collar.

7. The rock bolt according to claim 6, wherein the mesh clamp has a base in which the opening is formed and arms that extend from the base to a ring configured for engagement of the meshing sheet.

8. The rock bolt according to claim 7, wherein the base is planar and extends generally perpendicular to the axis of the rock bolt.

9. The rock bolt according to claim 6, wherein the mesh clamp has a base in which the opening is formed and a skirt extends from the base, wherein the skirt has a distal end remote from the base for engagement with the meshing sheet.

10. The rock bolt according to claim 9, wherein the base is planar and extends generally perpendicular to an axis of the rock bolt.

11. The rock bolt according to claim 3, wherein the internal thread of the connection portion is formed within a socket at said forwardmost part from which the extension projects.

12. The rock bolt according to claim 11, wherein the body is a nut rotatable on the extension towards said forwardmost part to drive axially the mesh clamp towards the socket.

13. The rock bolt according to claim 2, wherein the mesh clamp includes an opening through which the extension extends.

14. The rock bolt according to claim 13, wherein the opening has an internal diameter that is greater than an external diameter of the extension so that the mesh clamp is a loose fit about the extension.

15. The rock bolt according to claim 1, wherein the body includes a first fixed connection to the connection portion, whereby installation equipment can rotate the body to rotate both the body and the adapter together for threadably connecting the adapter to the trailing end of the elongate shaft of the rock bolt.

16. The rock bolt according to claim 15, wherein the first fixed connection of the body to the connection portion includes a shear pin extending between the body and the connection portion.

17. The rock bolt according to claim 15, wherein the first fixed connection of the body to the connection portion comprises a spot weld or braze, gluing or crimping between the body and the connection portion.

18. The rock bolt according to claim 1, wherein the body is mounted to the connection portion via a friction fit and the body is movable axially along the connection portion by application of a load applied to the body which is sufficient to overcome a friction connection between the body and the connection portion.

19. A meshing assembly for installation of meshing sheet against a surface of rock strata, the meshing assembly comprising:

a rock bolt as claimed in claim 1;

a first section of meshing arranged to be positioned against the surface of the rock strata;

a rock plate connectable to the trailing end of the rock bolt to bear against and urge the first section into contact with the surface of the rock strata;

a second section of meshing arranged to be positioned against the surface of the rock strata and overlapping the first section; and a meshing clamp connectable to the connection portion and configured to bear against and urge the second section into contact with the surface of the rock strata.

* * * * *